US005769406A

United States Patent [19]

Sato

[11] Patent Number: 5,769,406

[45] Date of Patent: Jun. 23, 1998

[54] SHEET PROCESSING APPARATUS FOR SHIFTING SHEETS TOWARD FRONT SIDE OF STACKING TRAY

[75] Inventor: Mitsuhiko Sato, Kawasaki, Japan

[73] Assignee: Canon Kabushiki Kaisha, Japan

[21] Appl. No.: 677,428

[22] Filed: Jul. 2, 1996

[30] Foreign Application Priority Data

Jul. 4, 1995 [JP] Japan ..... 7-189723

[51] Int. Cl.[6] ..... B65H 39/02

[52] U.S. Cl. ..... 270/58.08; 270/58.14

[58] Field of Search ..... 270/58.08, 58.09, 270/58.23, 58.11, 58.14

[56] References Cited

U.S. PATENT DOCUMENTS 4,965,629 10/1990 Hiroi et al. ..... 270/58.14
5,259,605 11/1993 Yoshie et al. ..... 270/58.08
5,330,170 7/1994 Uotani et al. ..... 270/58.08
5,434,661 7/1995 Takahashi et al. ..... 270/58.08
5,443,248 8/1995 Hayashi et al. ..... 270/58.23

*Primary Examiner*—John T. Kwon
*Attorney, Agent, or Firm*—Fitzpatrick, Cella, Harper & Scinto

[57] ABSTRACT

A sheet processing apparatus includes a plurality of trays for stacking sheets. A sheet shifting arrangement shifts the sheets on trays so that a portion of the sheets protrudes over the tray. A selector selects one of a plurality of processing modes for the sheets on the trays. A setting arrangement corresponding to each the processing modes manually sets whether the automatic sheet shifting by the sheet shifting means is to be performed. A controller controls the sheet shifting arrangement in accordance with the contents set by the setting arrangement and the processing mode selected by the selector, wherein with respect to the processing mode selected by the selector means, the controller automatically operates the sheet shifting arrangement in accordance with the automatic sheet shifting set by the setting arrangement and does not operate the sheet shifting arrangement in accordance when automatic sheet shifting is not set.

10 Claims, 11 Drawing Sheets

SHEET PROCESSING APPARATUS FOR SHIFTING SHEETS TOWARD FRONT SIDE OF STACKING TRAY

BACKGROUND OF THE INVENTION

1. Field of the Invention

The present invention relates to a sheet processing apparatus capable of skewing sheets on a tray toward the front side.

2. Related Background Art

Conventionally, some image forming apparatuses such as copying machines and printers comprise an automatic document feeding apparatus for feeding an original to a predetermined position of an image forming apparatus main body, and an automatic storing apparatus (sorter) for gathering or sorting sheets discharged from the image forming apparatus main body and storing them into a storage.

The automatic storing apparatus of an image forming apparatus of this sort includes a plurality of sheet trays. It is being attempted to push sheets toward the front side of an image forming apparatus main body by using a mechanism which aligns bundles of gathered or sorted sheets. Also, bundles of sheets can be stapled when a stapler is provided in the automatic storing apparatus. The front removing and the stapling operation of sheets can be automatically performed in a series of image forming operations. However, the user can also manually perform these operations after sheets are completely output. When these operations are manually performed, sheets output by one of a plurality of copy jobs can be stacked in a storage tray, stapled, and removed from the front side of the apparatus.

Unfortunately, the front removing function of the above conventional apparatus performs front removing for each copy job. Accordingly, it is not possible, for example, to stack sheets output by a plurality of copy jobs, staple the sheets, and remove them from the front side of the apparatus.

SUMMARY OF THE INVENTION

It is an object of the present invention to provide a sheet processing apparatus which has solved the above problem.

It is another object of the present invention to provide a user-friendly sheet processing apparatus in which a front removing function can be set in accordance with the mode of the apparatus.

Other objects and advantages of the invention will become apparent from the following detailed description taken in conjunction with the accompanying drawings.

PREFERRED EMBODIMENTS OF THE INVENTION

Preferred embodiments of the present invention will be described below with reference to the accompanying drawings.

(First Embodiment)

The first embodiment of the present invention will be described below with reference to FIGS. 1 to 16.

Figure 1:
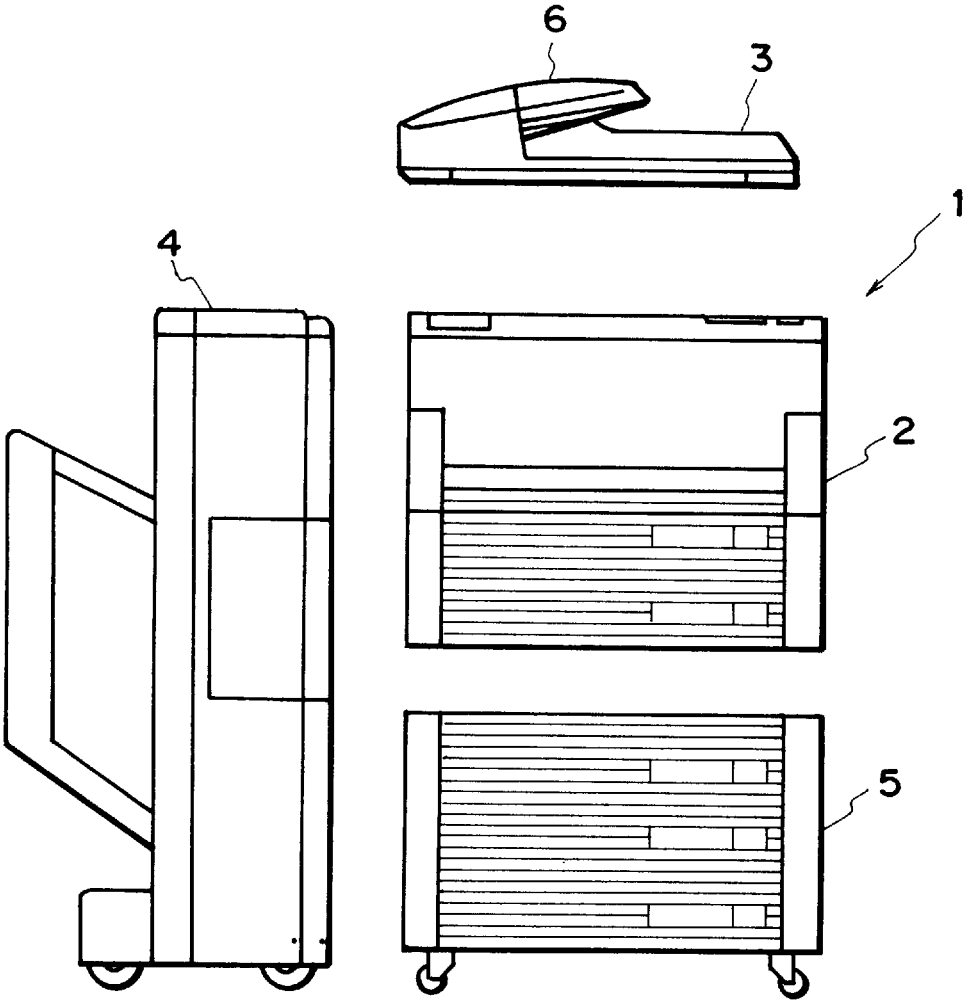
FIG. 1 is a longitudinal sectional view showing the construction of an image forming apparatus according to the first embodiment of the present invention.

FIG. 1 is a side view showing the construction of an image forming apparatus according to the first embodiment of the present invention. Referring to FIG. 1, an image forming apparatus 1 comprises an image forming apparatus main body 2, an automatic document feeding apparatus (DH) 3, an automatic storing apparatus (sorter) 4, and a sheet feeding apparatus 5.

The image forming apparatus main body 2 is of a conventionally well-known electrophotographic type, i.e., forms an image on a sheet and fixes the image on the sheet with heat. The automatic document feeding apparatus 3 is connected to the image forming apparatus main body 2 and feeds a bundle of originals placed on an original tray 6 to an exposure position of the image forming apparatus main body 2. The automatic document feeding apparatus 3 also has a known function of counting the number of originals. The automatic storing apparatus 4 is connected to the image forming apparatus main body 2, gathers or sorts output sheets, on which images are formed, from the image forming apparatus main body 2, and stores them in storage trays as storage units. This automatic storing apparatus 4 has a plurality of sheet storage trays (not shown).

The gathered or sorted sheets are pushed by an aligning bar 43 (see FIG. 2 to be described later) and a reference bar 42 so that the sheets are skewed toward the front side of the image forming apparatus main body 2. This allows a user standing in front of the image forming apparatus main body 2 to remove the sheets from the automatic storing apparatus 4. This operation of pushing the sheets toward the front side while skewing the sheets will be called a "front removing mode" hereinafter.

The sheet feeding apparatus 5 is connected as an option to the image forming apparatus main body 2. With this sheet feeding apparatus 5, images can be formed on both sides of a sheet.

The operation of the automatic storing apparatus 4 will be described below with reference to FIGS. 2 to 7 which illustrate the operation of the sheet storage tray of the automatic storing apparatus 4. FIGS. 2 to 7 are top views of a front removing mechanism of the image forming apparatus main body 2.

Figure 2:
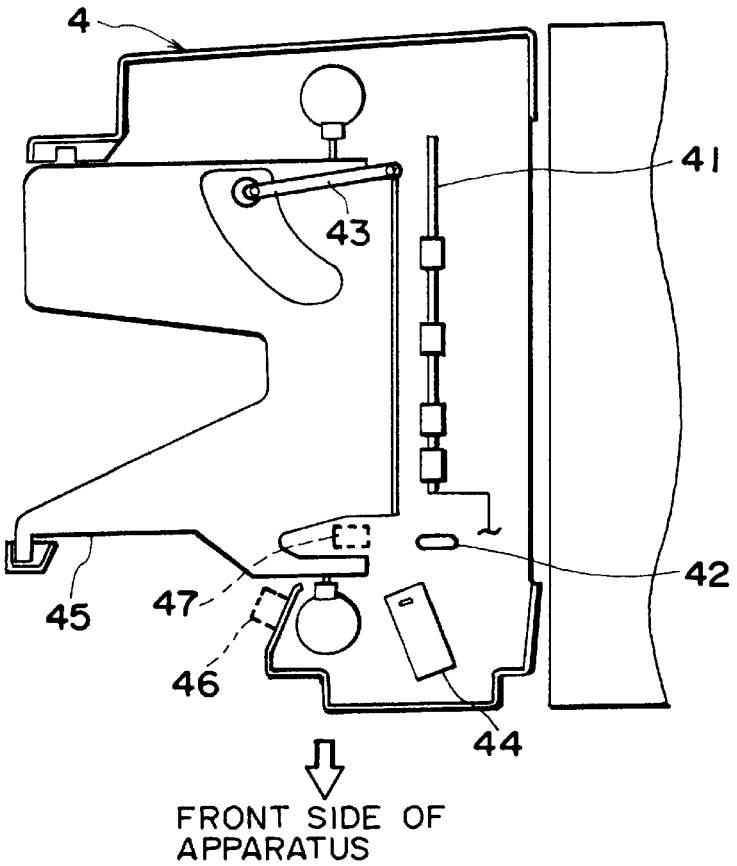
FIG. 2 is a view for explaining the operation of a sheet storage tray of an automatic storing apparatus of the image forming apparatus according to the first embodiment.

Individual parts of the automatic storing apparatus 4 will be described first with reference to FIG. 2. In FIG. 2, a sheet discharge roller 41 feeds sheets discharged from the image forming apparatus main body 2 onto a storage tray 45. The reference bar 42 can move from side to side in FIG. 2 and aligns, together with the aligning bar 43, the sheets on the storage tray 45. When the sheets are to be stapled, a stapler 44 moves forward in a direction indicated by the arrow and staples the sheets. After stapling the sheets; the stapler 44 returns to the position illustrated in FIG. 2. On the storage tray 45, about 50 sheets can be stacked. A front removing sensor 46 senses that the sheets are pushed toward the front side of the image forming apparatus 2. This front removing sensor 46 consists of a light-emitting diode and a light sensor. These light-emitting diode and light sensor are arranged in the lower and the upper portions, respectively, of the automatic storing apparatus 4. A sheet sensor 47 has a structure identical with that of the front removing sensor 46 and senses the sheets stacked in the storage tray 45.

Figure 3:
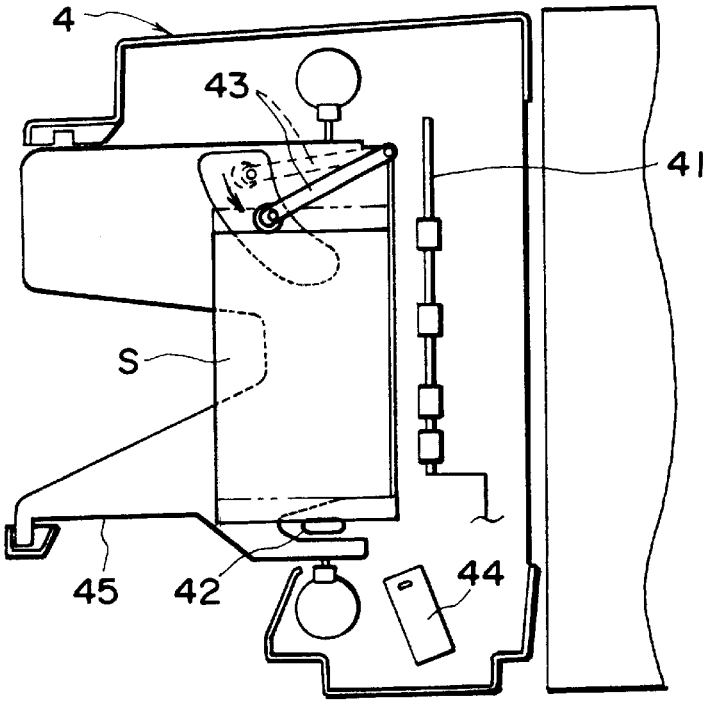
FIG. 3 is a view for explaining the operation of the sheet storage tray of the automatic storing apparatus of the image forming apparatus according to the first embodiment.

The way the reference bar 42 and the aligning bar 43 together push sheets toward the front side of the image forming apparatus main body 2 while skewing the sheets will be described step by step with reference to FIGS. 3 to 7. FIG. 3 shows the state in which a sheet S is stored in the storage tray 45. When the sheet S is stored in the storage tray 45, the aligning bar 43 moves in a direction indicated by the arrow and pushes the sheet S until it abuts against the reference bar 42. The aligning bar 43 repeats the same operation until all sheets S are stored in the storage tray 45.

Figure 4:
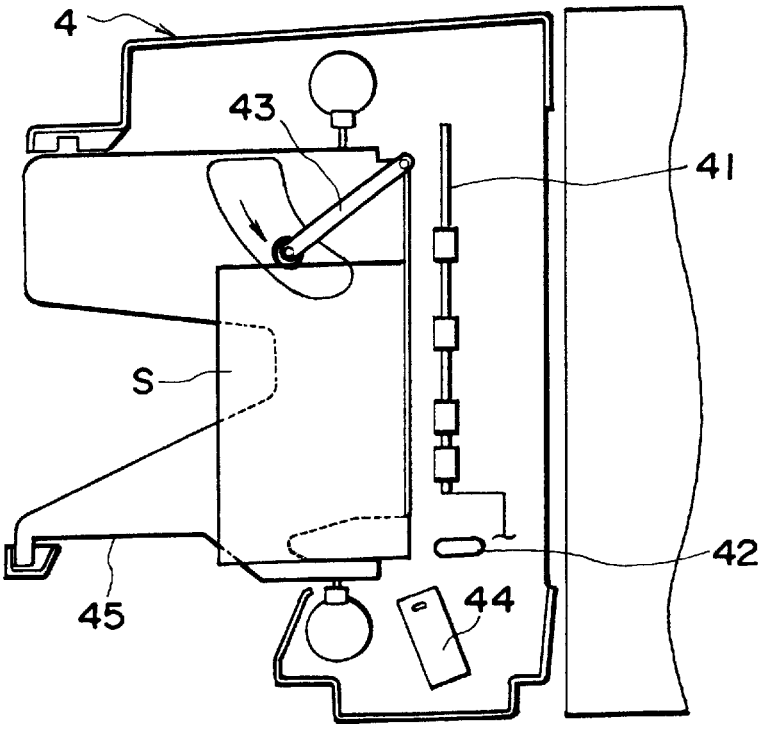
FIG. 4 is a view for explaining the operation of the sheet storage tray of the automatic storing apparatus of the image forming apparatus according to the first embodiment.

FIG. 4 shows the operation performed after all sheets S are stored in the storage tray 45. The reference bar 42 moves back to the standby position, and the aligning bar 43 further pushes the sheets S.

Figure 5:
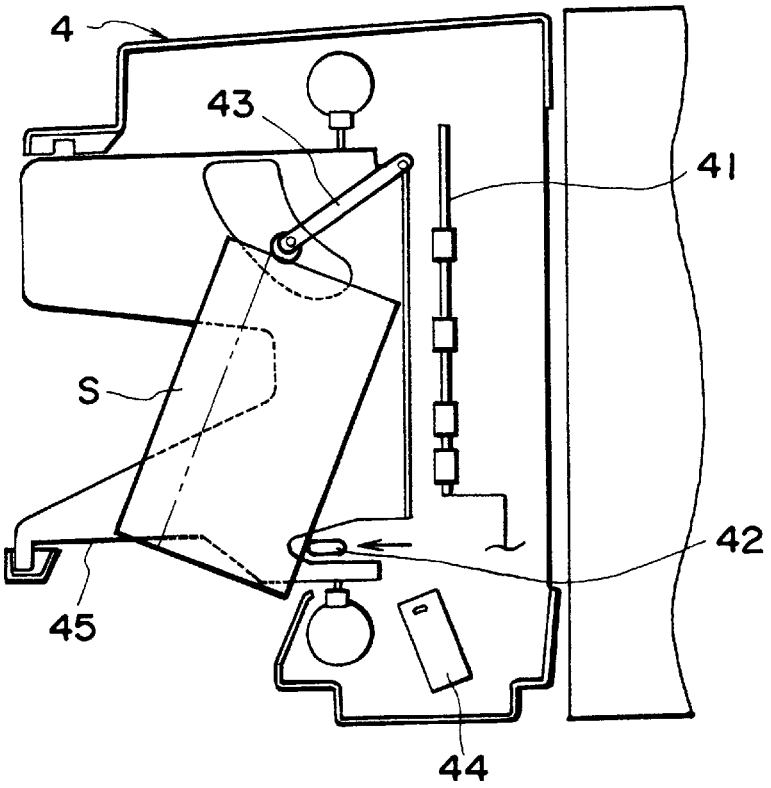
FIG. 5 is a view for explaining the operation of the sheet storage tray of the automatic storing apparatus of the image forming apparatus according to the first embodiment.

Furthermore, as illustrated in FIG. 5, the reference bar 42 moves forward to skew and point the sheets S in the direction of the removal port on the front side.

Figure 6:
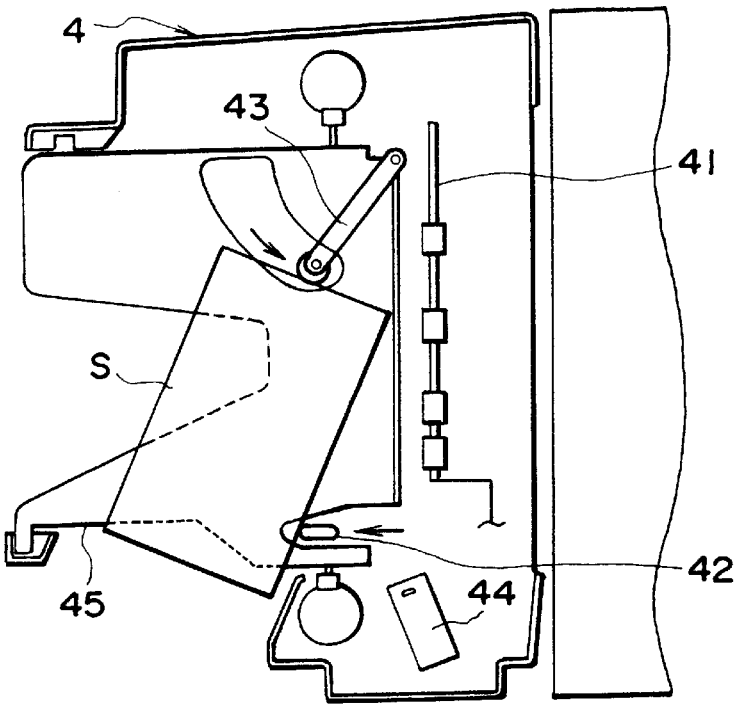
FIG. 6 is a view for explaining the operation of the sheet storage tray of the automatic storing apparatus of the image forming apparatus according to the first embodiment.
Figure 7:
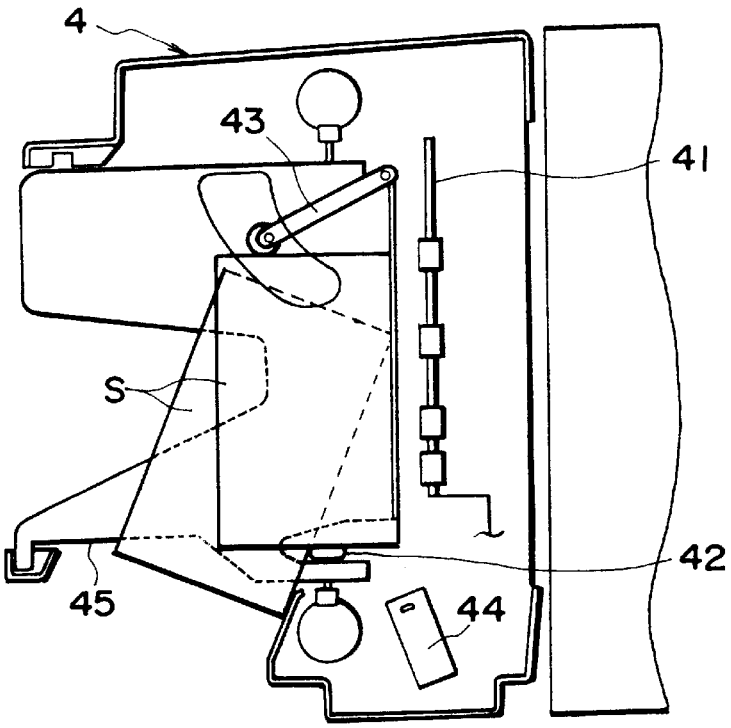
FIG. 7 is a view for explaining the operation of the sheet storage tray of the automatic storing apparatus of the image forming apparatus according to the first embodiment.

In addition, the aligning bar 42 pushes the sheets S toward the removal port as shown in FIG. 6. In the state shown in FIG. 6, the user can remove the sheets S from the front side of the image forming apparatus main body 2. As illustrated in FIG. 7, even when these sheets S are not removed, the reference bar 42 again can move forward to align a sheet S supplied by the next image forming operation. When stapling is to be performed by using the stapler 44, the stapling operation is performed in the state shown in FIG. 3.

One example of the hardware configuration of a microcomputer necessary to realize the present invention will be described below with reference to the block diagram in FIG. 8.

Figure 8:
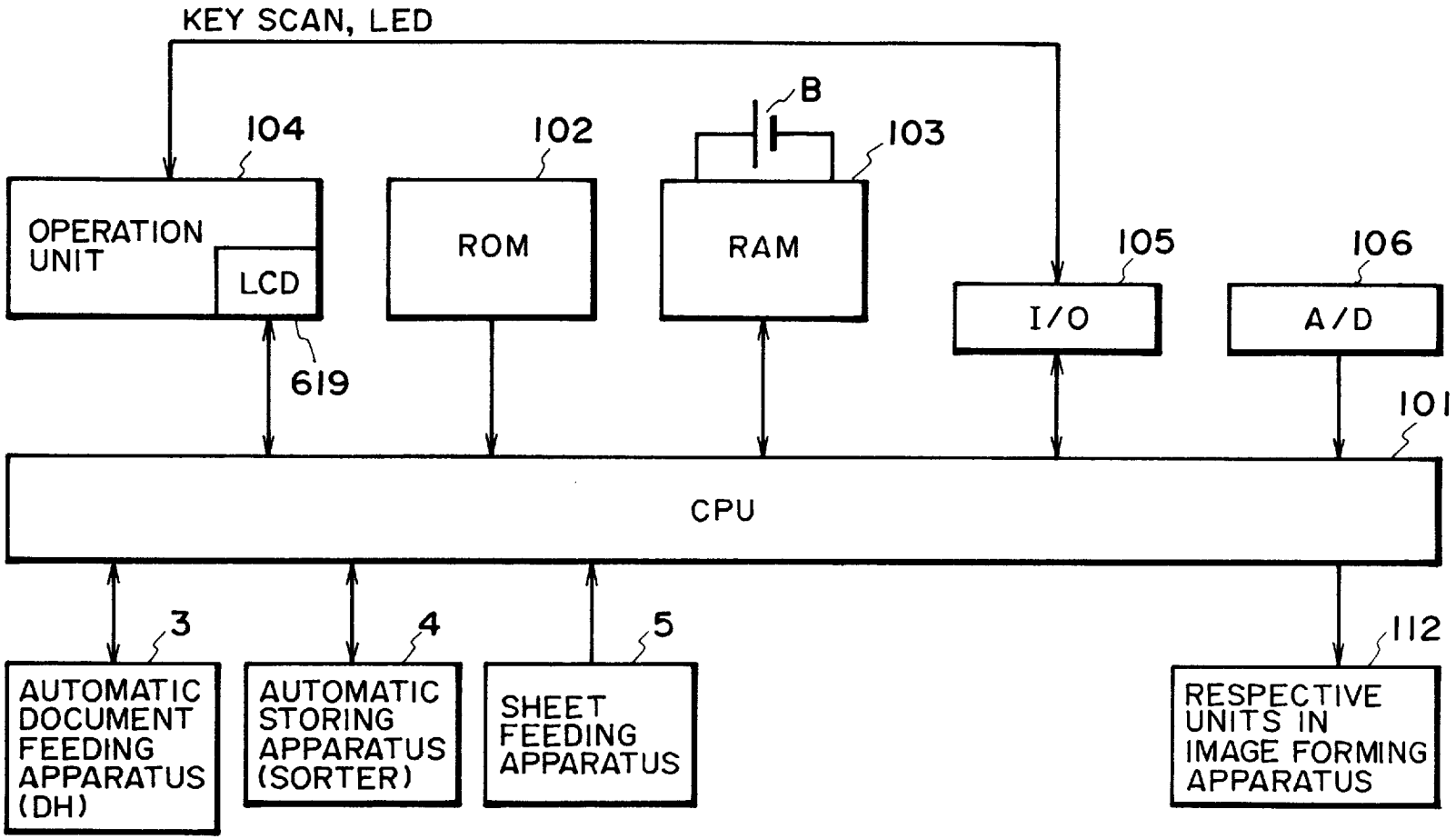
FIG. 8 is a block diagram showing the hardware configuration of a microcomputer of the image forming apparatus according to the first embodiment.
Figure 9:
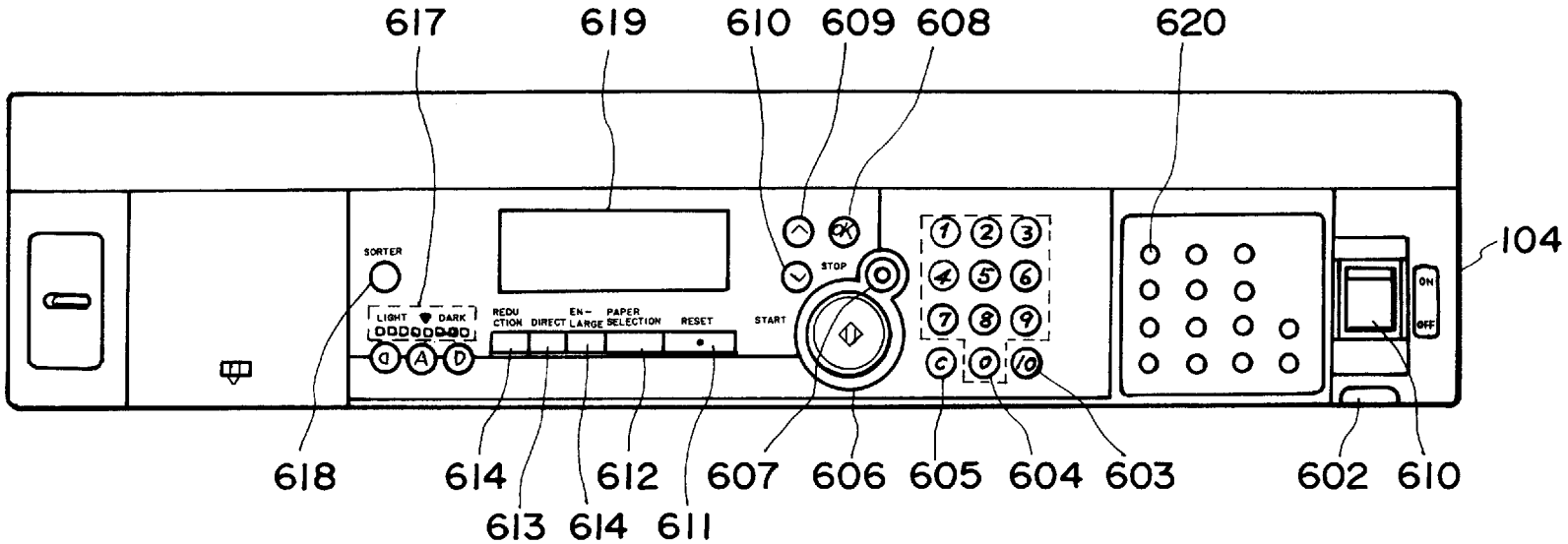
FIG. 9 is a plan view of an operation unit of the image forming apparatus according to the first embodiment.

Referring to FIG. 8, a CPU (Central Processing Unit) 101 controls respective units 112 in the image forming apparatus 1. A ROM (Read-Only Memory) 102 stores the contents (programs) of control, and a RAM (Random Access Memory) 103 stores data necessary for the control. The RAM 103 is backed up by a battery B so that the stored contents are not erased even when power is turned off. An operation unit 104 (details are shown in FIG. 9) is used to designate an image formation mode, e.g., the number of copies, the magnification, and a sheet feed cassette, and display the designated image formation mode on an LCD (Liquid Crystal Display) 619. An input/output unit (I/O) 105 controls input and output ports necessary for the control. An analog-to-digital converter (A/D) 106 converts analog data from, e.g., a temperature sensor of a fixing device and a room temperature sensor, necessary for the control, into digital data. This circuit is connected to the automatic document feeding apparatus (DH) 3 and the automatic storing apparatus (sorter) 4 connected to the image forming apparatus main body 2 and the sheet feeding apparatus 5 which can also be connected as an option to the image forming apparatus main body 2.

The operation unit 104 will be described with reference to FIG. 9. Referring to FIG. 9, a power switch 601 is used to turn on/off the power supply of the image forming apparatus 1. A pilot lamp 602 is lit while power is supplied to the image forming apparatus 1. A password key 603 is depressed, when a password is previously set, before and after an image forming operation. This inhibits any person except an authorized user from performing image forming operations. Ten keys 604 are used to input, e.g., the number of copies, the magnification, the password, and the numerical value for mode setting. A clear key 605 is used to return the number of copies, the password, the mode setting numerical value, and the like to their respective initial or default values. An image forming operation is started when a start key 606 is depressed.

When a stop key 607 is depressed during an image forming operation, the operation is stopped. An OK key 608 is depressed to determine set data during mode setting. Upward and downward arrow keys 609 and 610 are generally termed an up/down key and used to set the magnification or the mode. A reset key 611 is used to reset the image forming apparatus 1 to the default operation. A paper selection key 612 is used to select one of a plurality of paper storage cassettes arranged inside the sheet feeding apparatus 5. A direct key 613 is used to set the magnification to an equal magnification (original size). One of enlargement and reduction keys 614 is depressed when an original is to be enlarged or reduced. An automatic density adjusting (AE) key 615 is used to set a mode by which the density is automatically set. When the automatic density adjusting mode is set, a light-emitting diode arranged inside the automatic density adjusting key 615 is lit.

A manual density adjusting key 616 is depressed when the density is to be manually set. When the density is set by the manual density adjusting key 616, the internal light-emitting diode of the automatic density adjusting key 615 is turned off. A density indicator 617 consists of a plurality of (e.g., nine) light-emitting diodes. A central light-emitting diode indicates a standard density. When a density higher than the standard density is chosen, one of the light-emitting diodes on the right side of the central light-emitting diode is lit. When a density lower than the standard density is chosen, one of the light-emitting diodes on the left side of the central light-emitting diode is lit. The farther the position of the diode from the center, the higher or lower the density.

A paper discharge mode selection key 618 is used to designate the operation mode of the automatic storing apparatus 4. Selectable paper discharge methods are a non-sort mode in which output sheets S from the image forming apparatus are discharged, without being gathered, to a non-sort tray which is the top one of the storage trays 45 of the automatic storing apparatus 4, a sort mode in which only gathering is performed, a staple sort mode in which both gathering and stapling are performed, and a group mode in which sorting is performed. When any of the sort mode, the staple sort mode, and the group mode is selected, a light-emitting diode arranged inside the paper discharge mode selection key 618 is lit.

An LCD message display 619 displays information such as characters and graphics pertaining to the image forming apparatus 1. For example, the message display 619 displays the number of copies set by the ten keys 604, the magnification set by the enlargement or reduction key 614 or the direct key 613, the paper size selected by the paper selection key 612, and a message indicating the status of the image forming apparatus 1. A user mode key 620 is depressed to set the operation mode of the front removing mechanism.

A method of setting the operation mode of the front removing mechanism by depressing the user mode key 620 will be described below with reference to FIGS. 10 to 14. This setting is previously performed before an image forming operation.

Figure 10:
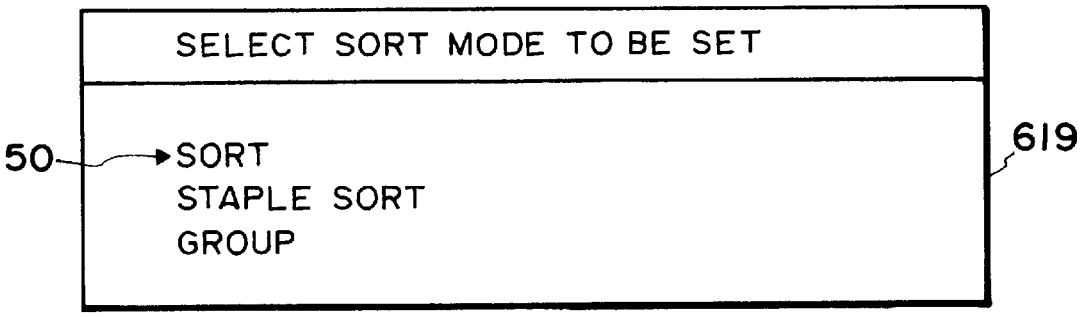
FIG. 10 is a view showing a display example on a message display of the operation panel of the image forming apparatus according to the first embodiment.
Figure 11:
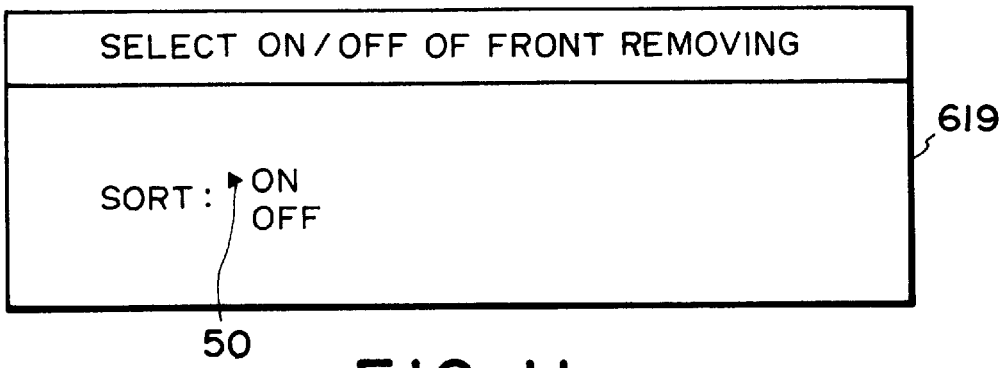
FIG. 11 is a view showing a display example on the message display of the operation panel of the image forming apparatus according to the first embodiment.
Figure 14:
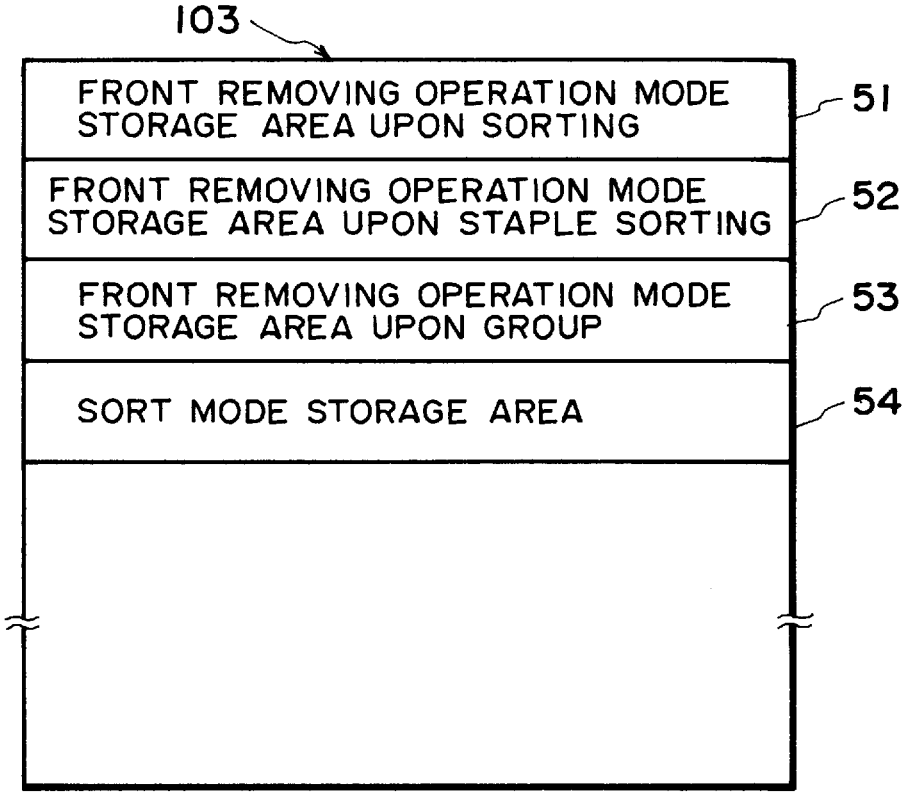
FIG. 14 is a view for explaining storage areas of a RAM of the image forming apparatus according to the first embodiment.

When the user mode key 620 in FIG. 9 is depressed, the message display 619 displays a selection screen shown in FIG. 10. The user selects the mode to be set by using the upward or downward arrow key 609 or 610 in FIG. 9, and determines the set mode by depressing the OK key 608. When the upward or downward key 609 or 610 is depressed, a pointer 50 in FIG. 10 moves in the corresponding direction to point the mode to be selected. When the OK key 608 is depressed while the pointer 50 is pointing the sort mode in the selection screen in FIG. 10, a selection screen in FIG. 11 is displayed. The user moves the pointer 50 to select ON or OFF by using the upward or downward arrow key 609 or 610, and determines by depressing the OK key 608. When ON is selected as in FIG. 11, "1" is written, as illustrated in FIG. 14, in a sort removing operation mode storage area 51 upon sorting at a predetermined address in the RAM 103, FIG. 8. When OFF is selected, "0" is written in the area 51.

Figure 12:
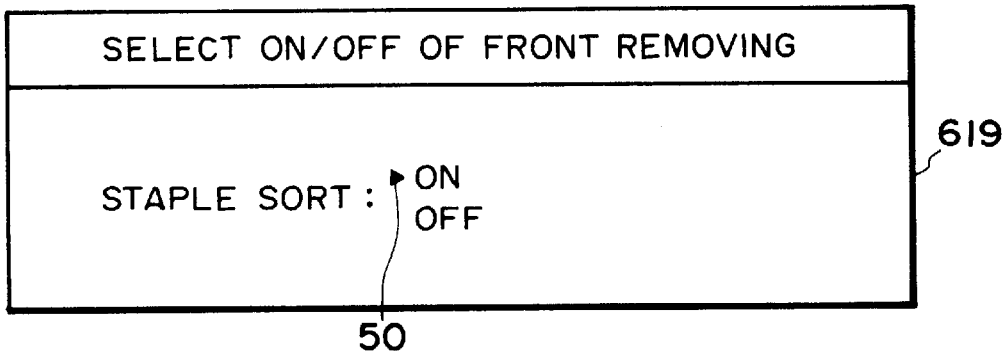
FIG. 12 is a view showing a display example on the message display of the operation panel of the image forming apparatus according to the first embodiment.
Figure 13:
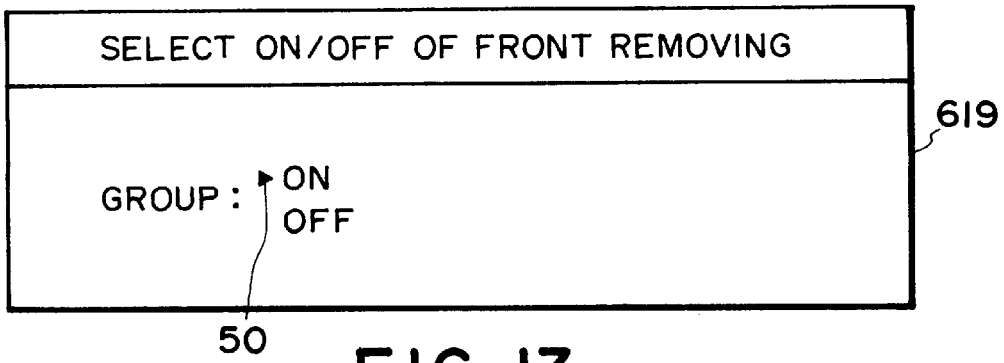
FIG. 13 is a view showing a display example on the message display of the operation panel of the image forming apparatus according to the first embodiment.

Analogously, if the staple sort mode and the group mode are selected in FIG. 10, selection screens shown in FIGS. 12 and 13, respectively, are displayed on the message display 619. When ON is selected in FIGS. 12 and 13, "1" s are written in a front removing operation mode storage area 52 upon staple sorting and a front removing operation mode storage area 53 upon group, respectively, at predetermined addresses in the RAM 103, as illustrated in FIG. 14. When OFF is selected, "0" s are written in these areas 52 and 53.

Figure 15:
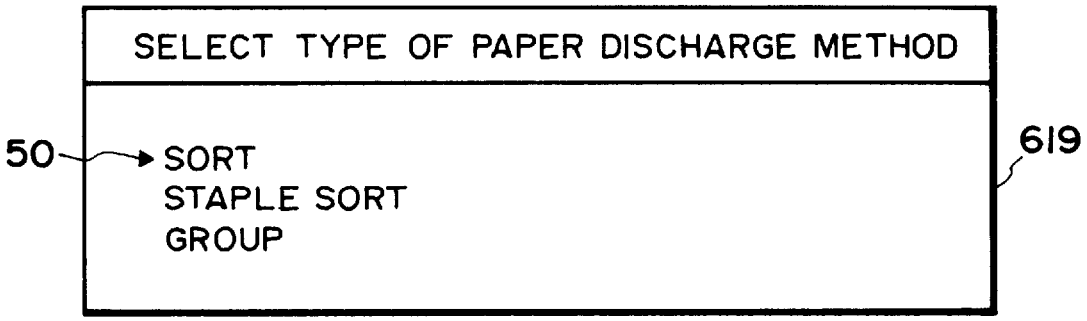
FIG. 15 is a view showing a display example on the message display of the operation panel of the image forming apparatus according to the first embodiment.

A method of setting the sort mode will be described below. This setting is done immediately before an individual image formation job. The processing when the sorter key 618 in FIG. 9 is depressed will be described with reference to FIGS. 14 and 15. When the sorter key 618 is depressed, a selection screen shown in FIG. 15 is displayed on the message display 619. As in the setting of the front removing operation mode, the user moves the pointer 50 by using the upward or downward arrow key 609 or 610 and determines the mode by depressing the OK key 608. The non-sort mode is set if the reset key 611 or the sorter key 618 shown in FIG. 9 is depressed while the selection screen in FIG. 15 is displayed on the message display 619. When the sort mode is set, "1" is written in a sort mode storage area 54 at a predetermined address in the RAM 103, as illustrated in FIG. 14. When the staple sort mode, the group mode, and the non-sort mode are set, "2", "4", and "0", respectively, are written in the area 54.

Figure 16:
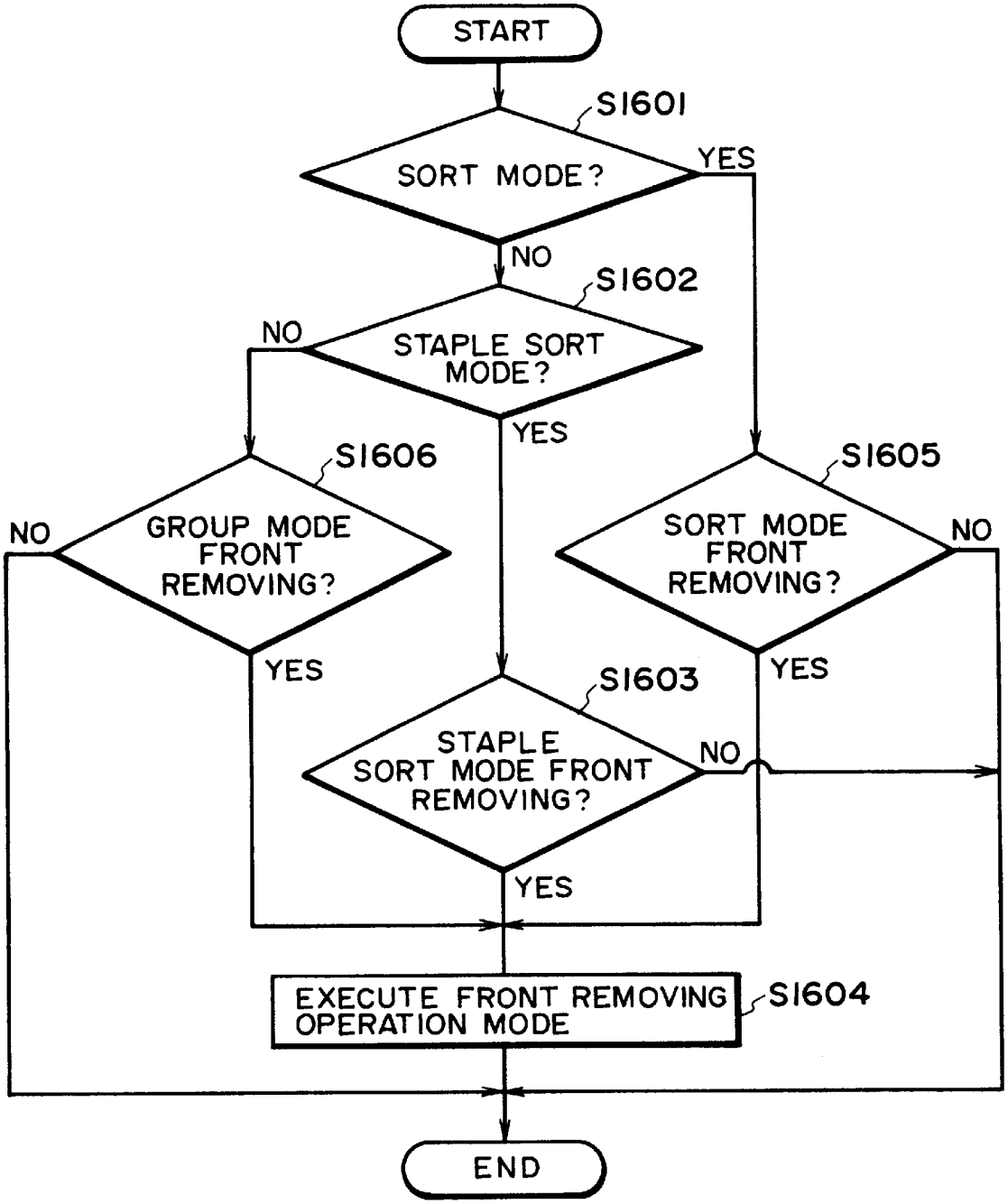
FIG. 16 is a flowchart showing the operation control procedure of a front removing mechanism of the automatic storing apparatus of the image forming apparatus according to the first embodiment.

The control procedure of the operation of the automatic storing apparatus 4 of the image forming apparatus 1 according to the first embodiment of the present invention will be described below with reference to the flowchart in FIG. 16. The control in FIG. 16 is executed after the image forming operation is completed and all output sheets are stored on the storage tray 45 of the automatic storing apparatus 4, and except when the non-sort mode is selected.

In step S1601, whether the sort mode is selected is checked. If the sort mode is selected, the flow advances to step S1605, the data stored in the front removing operation mode storage area 51 upon sorting of the RAM 103 shown in FIG. 14 is read out, and whether the front removing operation is selected is checked. If the data is "1", i.e., if the front removing operation mode is selected, the front removing operation mode is executed in step S1604. That is, the corners of the sheets on the storage tray 45 are moved to the front side, and the processing is completed. If the front removing operation mode is not selected in step S1605, the processing is terminated without moving the position of the sheets on the storage tray 45.

If the sort mode is not selected in step S1601, whether the staple sort mode is selected is checked in step S1602. If the staple sort mode is not selected, the flow advances to step S1606, the data stored in the front removing operation mode storage area 52 upon staple sorting of the RAM 103 shown in FIG. 14 is read out, and whether the front removing operation mode is selected is checked. If the front removing operation mode is selected, the front removing operation is executed in step S1604, and the processing is completed. If the front removing operation mode is not selected in step S1606, the processing is immediately terminated.

If the staple sort mode is not selected in step S1602, the flow advances to step S1603, the data stored in the front removing operation mode storage area 53 upon group of the RAM 103 shown in FIG. 14 is read out, and whether the front removing mode is selected is checked. If the front removing mode is selected, the front removing operation is executed in step S1604, and the processing is completed. If the front removing operation mode is not selected in step S1603, the processing is immediately terminated.

(Second Embodiment)

The second embodiment of the present invention will be described below with reference to FIGS. 17 and 18. Note that the basic configuration of an image forming apparatus according to the second embodiment is identical with that of the first embodiment described above and therefore will be described with reference to FIG. 1.

Figure 17:
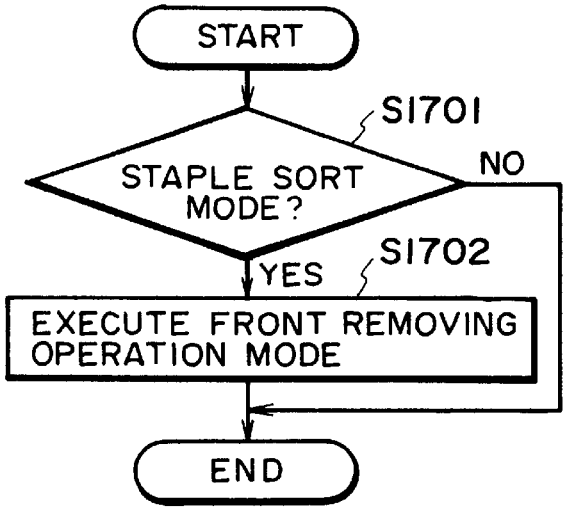
FIG. 17 is a flowchart showing the operation control procedure of a front removing mechanism of an automatic storing apparatus of an image forming apparatus according to the second embodiment of the present invention.

FIG. 17 is a flowchart showing the control procedure of an operation of a front removing mechanism of an automatic storing apparatus 4 of an image forming apparatus 1 according to the second embodiment. The control of this second embodiment is executed after an image forming operation is completed and all output sheets are stored on a storage tray 45 of the automatic storing apparatus 4. The operation mode (sort, staple sort, or group) of the sorter is stored in a sort mode storage area 56 of a RAM 103 shown in FIG. 18.

Figure 18:
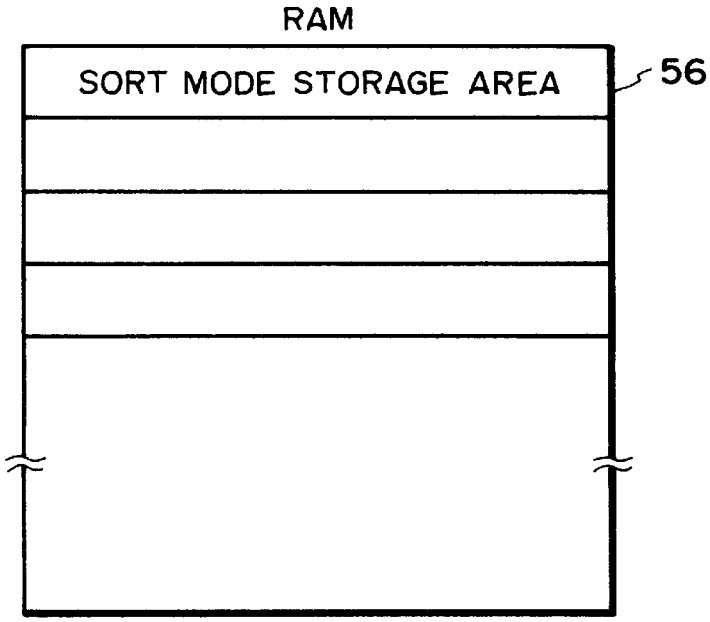
FIG. 18 is a view for explaining a storage area of a RAM of the image forming apparatus according to the second embodiment.

In step S1701 of FIG. 17, the data stored in the sort mode storage area 56 of the RAM 103 shown in FIG. 18 is read out. If the data is "2", i.e., if staple sort is selected, a front removing operation mode is executed in step S1702, and the processing is completed. If the staple sort is not selected, the processing is immediately terminated.

(Third Embodiment)

Figure 19:
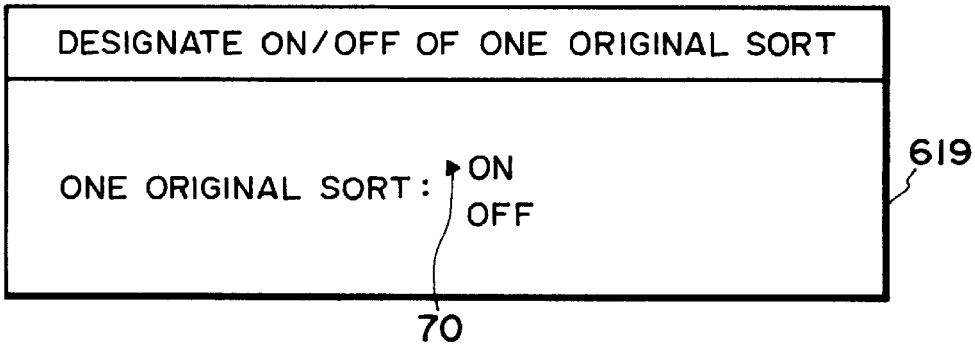
FIG. 19 is a view showing a display example on a message display of an operation panel of the image forming apparatus according to the second embodiment.

The third embodiment of the present invention will be described below with reference to FIGS. 19 to 21. Note that the basic configuration of an image forming apparatus according to the third embodiment is identical with that of the first embodiment described previously and therefore will be described with reference to FIGS. 1, 8, and 9.

The operation of a front removing mechanism of an automatic storing apparatus 4 of the image forming apparatus according to the third embodiment will be described below.

First, a method of setting the control mode of the front removing mechanism of the automatic storing apparatus 4 of the image forming apparatus according to the third embodiment will be described. While the image forming apparatus 1 is not performing image formation, a selection screen shown in FIG. 19 is displayed on a message display 619 when a user key 620 on an operation panel 104 is depressed. The user moves a pointer 70 to select ON or OFF by using an upward or downward arrow key 609 or 610, and determines by depressing an OK key 608. If ON is selected as shown in FIG. 19, "1" is written, as illustrated in FIG. 20, in an ON/OFF storage area 71 of one original sort at a predetermined address in a RAM 103. If OFF is selected, "0" is written in the area 71.

The control operation of the front removing mechanism of the automatic storing apparatus 4 of the image forming apparatus according to the third embodiment will be described below with reference to FIG. 21. FIG. 21 is a flowchart showing the control procedure of the operation of the front removing mechanism of the automatic storing apparatus 4. The control of this third embodiment is executed after an image forming operation is completed and all output sheets from an image forming apparatus main body 2 are stored on a storage tray 45 of the automatic storing apparatus 4. Also, the number of bundled originals stacked in an automatic document feeding apparatus 3 is counted and stored in a storage area 72 of number of originals of the RAM 103 as illustrated in FIG. 20.

Figure 20:
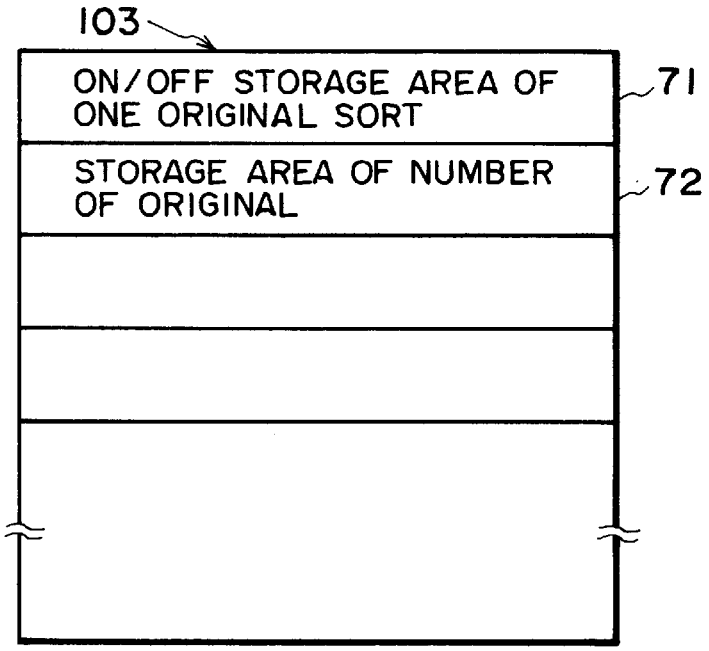
FIG. 20 is a view for explaining storage areas of a RAM of an image forming apparatus according to the third embodiment of the present invention.
Figure 21:
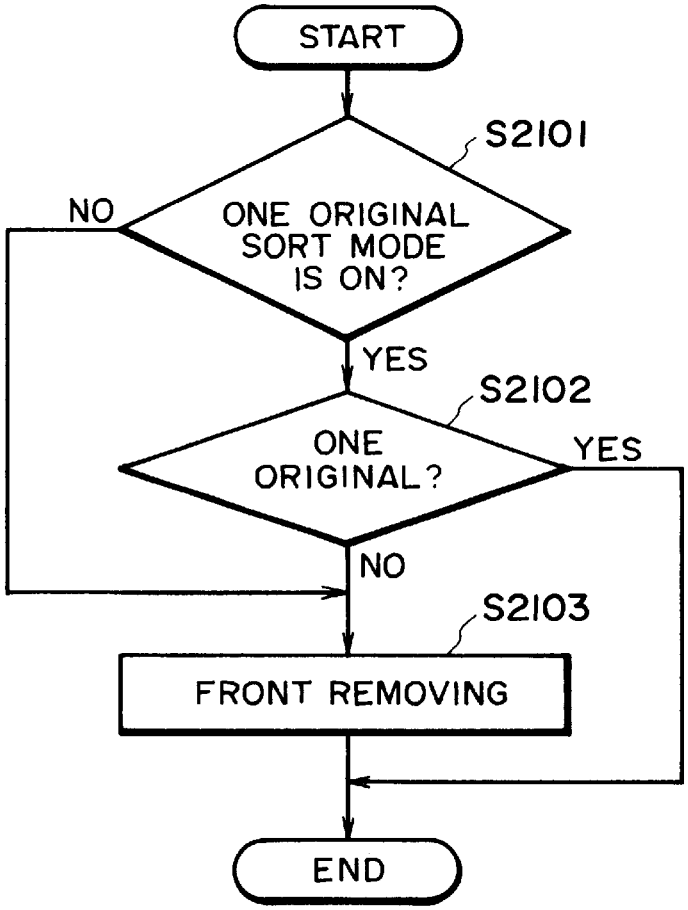
FIG. 21 is a flowchart showing the operation control procedure of a front removing mechanism of an automatic storing apparatus of the image forming apparatus according to the third embodiment.

Referring to FIG. 21, whether a one original sort mode is ON is checked in step S2101 by reading out the data stored in the ON/OFF storage area 71 of one original sort of the RAM 103 shown in FIG. 20. If this data is "1", whether the number of originals is one is checked in step S2102 by reading out the data stored in the storage area 72 of number of originals of the RAM 103 shown in FIG. 20. If this data is "2" or more or if the one original sort mode is not ON in step S2101, a front removing operation mode is executed in step S2103, and the processing is completed. If the number of originals is one in step S2102, the processing is immediately terminated.

What is claimed is:

1. A sheet processing apparatus comprising:

a plurality of trays for stacking sheets;

sheet shifting means for shifting the sheets on a tray so that a portion of the sheets protrudes over said tray;

selecting means for selecting one of a plurality of processing modes for the sheets in said trays;

setting means corresponding to each of the processing modes for manually setting whether automatic sheet shifting by said sheet shifting means is to be performed; and control means for controlling said sheet shifting means in accordance with the contents set by said setting means and said processing mode selected by said selecting means, wherein with respect to the processing mode selected by said selecting means, said control means automatically operates said sheet shifting means in accordance with the automatic sheet shifting set by said setting means and does not operate said sheet shifting means when automatic sheet shifting is not set.

2. An apparatus according to claim 1, further comprising:

stapling means for stapling the sheets on said plurality of trays; and second control means for performing one of a sort mode in which the sheets are sorted by said plurality of trays and the stapling processing by said stapling means is not performed, and a staple sort mode in which the sheets are sorted by said plurality of trays and stapled by said stapling means, wherein said first setting means sets one of the sort mode and the staple sort mode.

3. An apparatus according to claim 2, wherein said second control means can further perform a group mode in which the sheets are grouped in accordance with types thereof by using said plurality of trays, and said first setting means sets one of the sort mode, the staple sort mode, and the group mode.

4. An apparatus according to claim 1, wherein said sheet shifting means comprises a bar member extending vertically.

5. An apparatus according to claim 4, wherein said sheet shifting means comprises two bar members, a first bar member pushes the sheets on said tray toward the front side, and a second bar member shifts the sheets such that one corner of the sheets points in a direction of the front side.

6. An apparatus according to claim 1, wherein said sheet processing apparatus is connected to an image forming apparatus, and said sheet shifting means operates after said image forming apparatus discharges one group of sheets onto said tray.

7. A sheet processing apparatus operable in a plurality of processing modes comprising:

a plurality of trays for stacking sheets;

sheet shifting means for shifting the sheets on said tray so that a portion of the sheets protrudes over the tray;

setting means for manually setting whether automatic sheet shifting by said sheet shifting means is to be performed; and control means for controlling said sheet shifting means in accordance with the contents set by said setting means, wherein in accordance with a selected process mode, said control means automatically operates said sheet shifting means in accordance with the automatic sheet shifting set by said setting means and does not operate said sheet shifting means when the automatic sheet shifting is not set.

8. An apparatus according to claim 7, wherein said sheet shifting means comprises a bar member extending vertically.

9. An apparatus according to claim 8, wherein said sheet shifting means comprises two bar members, wherein a first bar member pushes the sheets on said tray toward the front side, an a second bar member shifts the sheets such that one corner of the sheets points in a direction of the front side.

10. An apparatus according to claim 7, wherein said sheet processing apparatus is connected to an image forming apparatus, and said sheet shifting means operates after said image forming apparatus discharges one group of sheets onto said tray.

* * * * *

UNITED STATES PATENT AND TRADEMARK OFFICE

CERTIFICATE OF CORRECTION

PATENT NO. : 5,769,406

DATED : June 23, 1998

INVENTOR(S) : MITSUHIKO SATO

It is certified that error appears in the above-identified patent and that said Letters Patent is hereby corrected as shown below:

On the title page:

Item [73] ASSIGNEE:

"Canon Kabushiki Kaisha, Japan" should read --Canon Kabushiki Kaisha, Tokyo, Japan--.

Item [57] ABSTRACT:

Line 6, "each" should read --each of--; and
Line 16, "when automatic sheet shifting is not set." should read --with automatic sheet shifting not being set.--.

COLUMN 3:

Line 43, "sheets;" should read --sheets,--.

COLUMN 5:

Line 4, "Amanual" should read --A manual--.

UNITED STATES PATENT AND TRADEMARK OFFICE

CERTIFICATE OF CORRECTION

PATENT NO. : 5,769,406

DATED : June 23, 1998

INVENTOR(S) : MITSUHIKO SATO

It is certified that error appears in the above-identified patent and that said Letters Patent is hereby corrected as shown below:

COLUMN 6:

Line 26, "and" should be deleted.

Signed and Sealed this

Twentieth Day of April, 1999

*Attest:*

Q. TODD DICKINSON

*Attesting Officer*

*Acting Commissioner of Patents and Trademarks*